United States Patent [19]

Neubaum

[11] 4,160,605

[45] Jul. 10, 1979

[54] INK RIBBON BOX

[75] Inventor: August E. Neubaum, Heppenheim, Fed. Rep. of Germany

[73] Assignee: Pitney Bowes Deutschland GmbH, Fed. Rep. of Germany

[21] Appl. No.: 836,367

[22] Filed: Sep. 26, 1977

[51] Int. Cl.[2] ..... B41J 33/14

[52] U.S. Cl. ..... 400/208; 242/71.2; 354/275

[58] Field of Search ..... 400/207, 208, 208.1, 400/246; 101/336; 96/201; 206/387, 391, 393, 403, 404, 405, 406; 354/275; 242/71.1, 71.2, 197, 198, 199, 200

[56] References Cited

U.S. PATENT DOCUMENTS

| | | | |
|---|---|---|---|
| 797,888 | 8/1905 | Follett | 400/208 |
| 2,257,424 | 9/1941 | Meyer | 354/275 |
| 3,075,627 | 1/1963 | Kuckhoff | 400/208 |
| 3,628,435 | 12/1971 | Nerwin | 354/275 |
| 3,653,604 | 4/1972 | Wiesner et al. | 242/71.2 |
| 3,687,037 | 8/1972 | Nerwin | 242/71.2 |
| 3,774,538 | 11/1973 | Bullock | 400/208 |
| 3,969,740 | 7/1976 | Hahn et al. | 242/71.2 X |
| 4,041,626 | 8/1977 | Ellis et al. | 242/71.2 X |
| 4,083,472 | 4/1978 | Wharam | 206/393 X |

*Primary Examiner*—Ernest T. Wright, Jr.

*Attorney, Agent, or Firm*—Peter Vrahotes; William D. Soltow, Jr.; Albert W. Scribner

[57] ABSTRACT

This invention relates to an ink ribbon box, and more particularly, to an ink ribbon box to be used in small printers. The ink ribbon box has two ink ribbon roll receiving cylinders that extend parallel to each other and which are connected at their outer ends through bridging flanges.

12 Claims, 5 Drawing Figures

FIG. 1
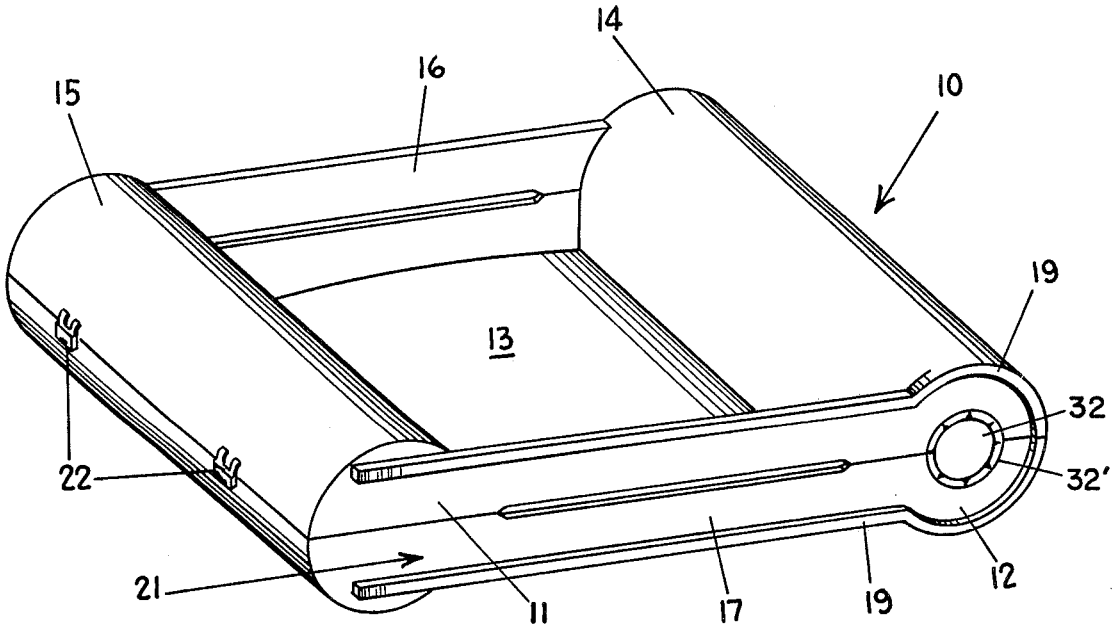
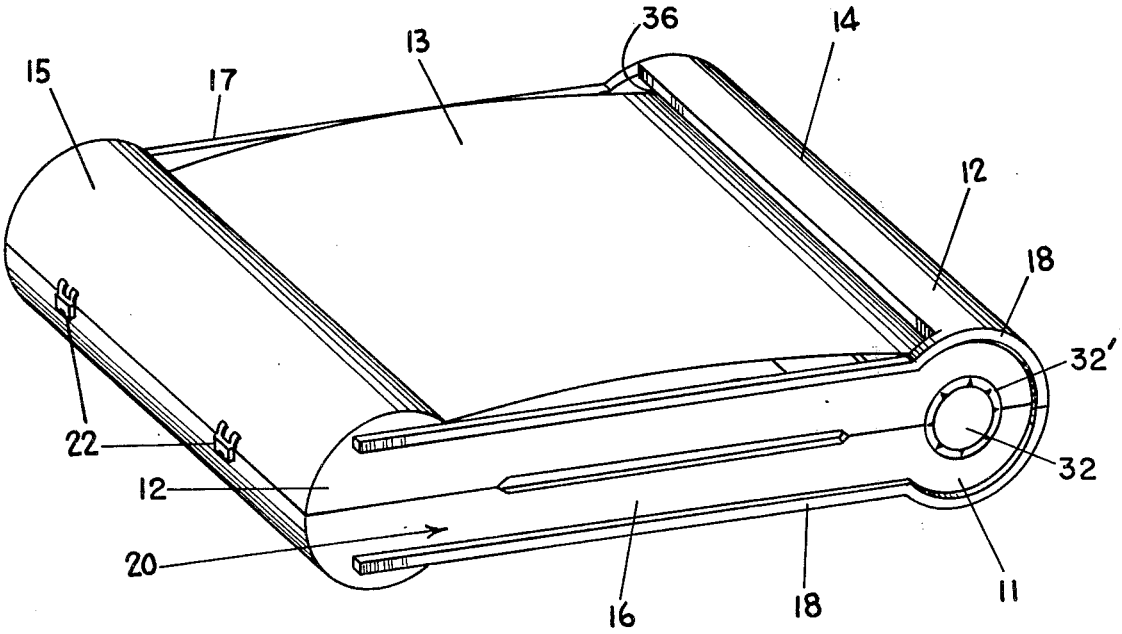
FIG. 2

INK RIBBON BOX

BACKGROUND OF THE INVENTION

Boxes comprising two cylinders which extend parallel and which are connected at their outer ends by bridging flanges are known, for example, to receive photographic film.

In printing devices, such as address printing devices and the like, an ink ribbon is usually withdrawn from an ink ribbon roll mounted in the housing and rewound on another ink ribbon roll. An especially simple, neat and convenient operation is attained by arranging the ink ribbon and the ink ribbon rolls within an ink ribbon box. However, in this case, difficulties arise if the ink ribbon box is incorrectly inserted into the printing device by the operator. This causes printing failure, contamination of the printing device and other disturbances regarding operation.

The object of the innovation, therefore, is to prevent the incorrect top to bottom insertion, by having the wrong face exposed, i.e. reversed insertion, or by having the sides of the ribbon box reversed, i.e. with wrong side alignment of the ink ribbon box in the printing device.

SUMMARY OF THE INVENTION

For obtaining the above mentioned benefits, the ink ribbon box of the instant invention has at the outer sides of the bridging flanges, outwardly projecting guide fins which define a guide channel at opposite sides of the box. The guide channel at one of these sides of the box is wider than the guide channel of the other side. The guide channels can be closed at one end of the box and open at the other end of the box. The printing device (machine) is correspondingly constructed by having guide rails of different widths at opposite sides, therefore, incorrect face insertion of the ink ribbon box is impossible. Although the smaller guide rail will pass into the wider guide channel, it will be impossible for the wider guide rail to pass into the smaller guide channel. Thereby an incorrect reversed insertion of the ink ribbon box into the printing device is reliably prevented. The same is true regarding the insertion of the wrong end for the guide channel is closed at one of its ends, therefore, it is only possible to insert the ink ribbon box into the printing device with the open end. The ink ribbon box, therefore, is designed in a manner that an incorrect insertion is reliably prevented.

BRIEF DESCRIPTION OF THE DRAWING

FIG. 1 is a perspective view of an ink ribbon box incorporating the instant invention viewed in the direction of a first side and first end, FIG. 2 is a perspective view of the ink ribbon box viewed from the underside as seen in FIG. 1.

DETAILED DESCRIPTION OF THE PREFERRED EMBODIMENTS

Figure 3:
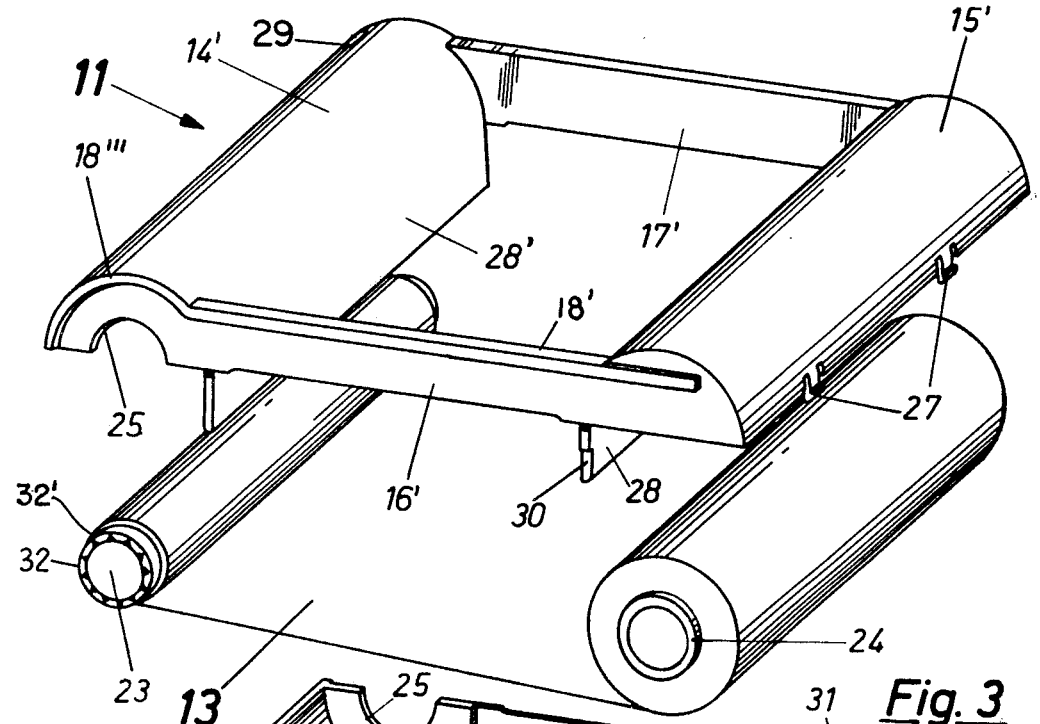
FIG. 3 is an exploded view of the ink ribbon box shown in FIG. 1.

An ink ribbon box is provided that has two halves, each half having two semicylinders and two spaced bridging flange halves connecting the two semicylinders. Guide fins are provided at the outer margins of the bridging flange halves, forming guide channels when the box is closed. The two halves of the box can be connected to each other by means of a snap breech mechanism. A suitable embodiment of such snap breech mechanism can be obtained by arranging flexible hooks at a jointed edge of one of the semicylinders and associated inflexible latches at the corresponding other semicylinder into which the hook locks are received when the halves of the box are pressed together. In lieu of this, a breech mechanism with bent leafsprings or the like could be used. The construction of the ink ribbon box comprising two halves of the box, facilitates the loading of the box and a more simple manufacture. The correct assembling of the halves of the box is ensured by the respective shapes of the halves of the boxes. Particularly, the flexible hooks can be arranged at one of the halves of the box and the inflexible latches at the other. In order to prevent the sidewise inverted pressing together of both the halves of the box, a mechanical locking means is provided which is in the form of recesses at one of the halves of the box and associated stepped notches at the corresponding other half of the box. Thereby, it is reliably ensured that the correct shape of the guide channel at each bridging flange will be attained when the halves of the box are pressed together during the assembling of the box.

The different width of the guide channel at opposite sides of the ink ribbon box is attained spontaneously if the guide fins arranged at the outer margins of the bridging flanges have different widths. In an advantageous manner, the guide fins extend circumferentially at the end of that cylinder at which the guide channel is closed. In this way, the guide fin is not an impediment as it forms an extension of the cylinder surface (at the cylinder base) and projects only in an axial direction. In this way, a bar against incorrect insertion is reliably ensured.

Generally, such a design for the guide fins will be suitable in which an essentially U-shaped guide channel is defined. In this case, a bar against an insertion of the box in the printing device with the wrong end in first will be ensured and the guide channels will be defined, which based on their different widths on opposite sides of the ink ribbon box, will also prevent an incorrect insertion.

According to an embodiment of the invention both the semicylinders of one half of the box are cut out at its sides facing each other, and the cutaway portion is formed as a cylindrical segment i.e., an elongated opening extending longitudinally relative to the semicylinder, while the semicylinders of the other half of the box are each provided with a tangential projection. Thereby, at each cylinder an outlet-slot for the ink ribbon is formed, which in this way lies more or less at the surface of the one side of the ink ribbon box.

In this way, a reliable guidance and support of the ink ribbon within each of the cylinder is ensured.

Appropriately, one of the cylinders will be provided with a window through which the advancement of the ink ribbon and, particularly, the end of the ink ribbon can be detected.

Referring to FIG. 1 of the drawing, the ink ribbon box 10 comprises two halves 11 and 12. The ink ribbon box 10 serves as a receptable for an ink ribbon 13. It comprises two cylinders 14 and 15 which extend parallel to each other and which are connected and spaced from each other through spaced bridging flanges 16 and 17. The bridging flanges 16, 17 join the respective ends of the cylinders 14, 15 and are arranged in parallel planes which are perpendicular to the axis of the cylinders 14, 15. Thereby, the bridging flanges 16, 17 secure the cylinders 14, 15 at their inner sides between them. Essentially, the end surfaces of the cylinders 14, 15 form part of the bridging flanges 16, 17.

The bridging flanges 16, 17 are provided at their outer sides with projecting guide fins 18 and 19. The guide fins 18, 19 extend parallel to each other across the largest part of the bridging flanges 16, 17 forming in this way guide channels 20, 21. The guide channel 20 which is formed by the guide fins 18 has a smaller width than the guide channel 21 formed by the guide fins 19. The width of the guide channels 20, 21 is defined by the distance of the guide fins 18, 19 in the area in which the guide fin portions 18', 18'' (See FIG. 3) extend parallel to each other. Further, the guide fins 18, 19 have circumferential portions 18''' at the respective ends of the same cylinder 14.

At the other cylinder 15 the guide fins 18, 19 extend linearly onto the cylinder surface. Consequently, on both bridging flanges 16, 17 at each respective outer side, a substantially U-shaped guide channel 20, 21 is formed, which at the cylinder 15 is open in the inserting direction, shown at the left in FIG. 2, and at the cylinder 14 is closed. The guide channels 20, 21 of course, only exist when the halves 11, 12 of the box 10 are put together, as illustrated in the FIGS. 1 and 2, and maintained in this position by snap breech mechanisms 22.

In FIG. 3 the ink ribbon box 10 is shown in an exploded view. The ink ribbon 13 is disposed about a pair of ink rolls 23 and 24 and may be withdrawn from the ink ribbon roll 24 and fed to the ink ribbon roll 23. Above the ink ribbon 13 and the ink ribbon rolls 23, 24 is the first half 11 of the ink ribbon box 10 with both semicylinders 14', 15' and the bridging flange halves 16', 17'. Beneath this is the second half 12 of the box 10 with semicylinders 14'', 15'' and bridging flange halves 16'', 17''. The bridging flange halves 16', 17' and 16'', 17'' are each provided within the area of the base of the semicylinders 14' and 14'' with semicircular cut-outs 25 through which receiving lugs 32 of the ink ribbon roll 23, provided at its outer end with notches 32', will extend when the ink ribbon box 10 is in its assembled form in order to engage the lugs 32 with ink ribbon driving means (not shown) so that the ink ribbon roll 23 may be rotated to pull the ribbon 13 from the ink ribbon roll 24. The semicylinders 14'', 15'' have cut-out portions 34 which define longitudinally extending openings 36 when the ink ribbon box 10 is assembled to allow passage of the ink ribbon 13.

Figure 4:
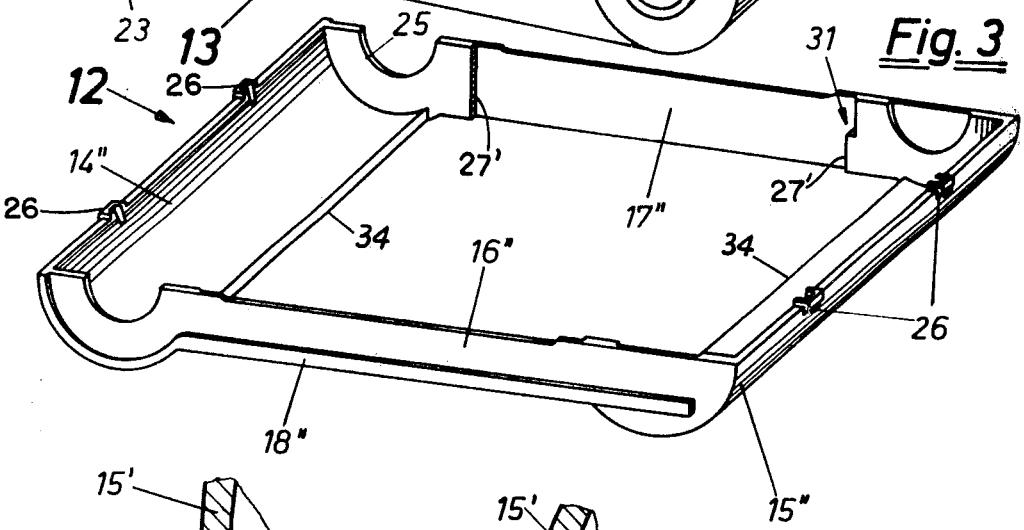
FIG. 4 is a partial cross-sectional view of a detail of the locking device for the halves of the ink ribbon box, shown in FIG. 3 and, FIG. 5 is a corresponding view of the detail according to FIG. 4 showing the locking device in a locked position.
Figure 4:
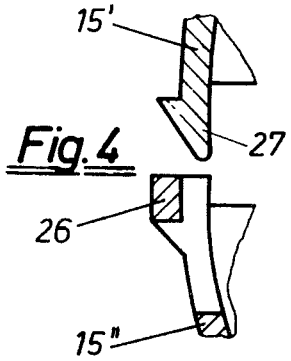
Figure 5:
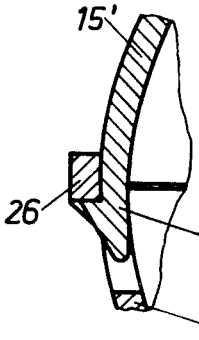

Along the jointing edge of the semicylinder 15'', latches 26 are provided for forming a snap breech mechanism 22, while on the semicylinder 15', at corresponding positions, flexible hooks 27 are provided. Correspondingly, the semicylinder 14'' is provided with flexible hooks (not shown) and the semicylinder 14'' with latches 26. Consequently, the upper half 11 of the box 10 is provided only with hooks 27 and the lower half 12 of the box 10 with latches 26, thereby preventing jamming of the ink ribbon rolls 23, 24. Referring to FIGS. 4 and 5 details can be seen of the snap breech mechanism 22. When the halves 11 and 12 of the box 10 are put together in the correct manner, a respective latch 26 is positioned under a respective flexible hook 27. If the halves 11, 12 of the box 10 now are slightly pressed together the flexible hook 27 moves towards the interior, passes the latch 26 and engages the latch 26 when the halves 11, 12 of the box 10 are in their correct position.

In order to arrange that the openings 36 for the ink ribbon 13 in the cylinders 14, 15 is positioned properly the semicylinders 14'', 15'' are provided with cutaway portions 27' as can be best seen in FIG. 3, while the semicylinders 14', 15' are provided with tangential projections 28, 28' which are arranged parallel to each other.

Moreover, the cylinder 14 is provided with a window 29 for the end of the ink ribbon 13 in the semicylinder 14'.

The improper assembly of the halves 11 and 12 of the box 10 is prevented because the corner area of the projection 28 is provided with a recesses 30 (only one being shown) at the semicylinder 15' to which stepped notches 31 in the cutaway portions 27' of the other half 12 of the box 10 are associated. As the projection 28' of the semicylinder 14' is not provided with such recesses 30, in the case where the halves 11, 12 of the box 10 are pressed together in an end to end reversed manner, the extension 28' would abut against the stepped notches 31 which would prevent further assembly.

What is claimed is:

1. An ink ribbon box for use in a small printer, comprising: two cylindrical members oppositely spaced, parallel to one another, a pair of bridging flanges connected to the opposed ends of said two cylindrical members, each of said cylindrical members having an end to end extending opening, means within each of said cylindrical members for receiving an ink ribbon roll, the outer sides of said bridging flanges each having outwardly projecting guide fins which define guide channels thereon, one of said guide channels having a width which is different from the width of the other of said guide channels.

2. The ink ribbon box according to claim 1, wherein said guide channels are closed at one end and are open at the opposite end.

3. An ink ribbon box for use in a small printer, comprising two halves, each half having a pair of opposed semicylinders joined at their ends by two bridging flange members, one of said halves having within each of its semicylinders means for receiving ink ribbon rolls, means for securing said two halves to one another to form an assembled box, the semicylinders of one half having cut out portions addressing each other, and guide fins on said bridging flange members that form a guide channel when said box is in its assembled condition.

4. The ink ribbon box according to claim 3, wherein said means for securing said halves of the ink ribbon box is a snap breech mechanism.

5. The ink ribbon box according to claim 4, wherein said snap breech mechanism comprises flexible hooks located on said semicylinder of a first of said halves and aligned latches at a corresponding location on the semicylinders of the second of said halves wherein said hooks are operative to engage said latches when the halves of the box are pressed together.

6. The ink ribbon box according to claim 5, wherein one of the halves of said box is provided with hooks only, and the other half of said box with latches only.

7. The ribbon box according to claim 3 wherein said guide fins are located at the respective outer sides of the bridging flanges so as to form channels of different widths at opposites sides of the box.

8. The ink ribbon box according to claim 7 wherein said guide fins extend circumferentially around the outer surface of a cylinder formed by adjacent semicylinders that oppose one another when said box is assembled to define a closed end of said channel.

9. The ink ribbon box according to claim 3 wherein said guide fins form a substantially U-shaped guide channel.

10. The ink ribbon box according to the claim 3 wherein one of the semicylinders is provided with a window.

11. An ink ribbon box for use in a small printer, comprising two halves, each half having a pair of opposed semicylinders joined at their ends by two bridging flange members, one of said halves having within each of its semicylinders means for receiving ink ribbon rolls, means for securing said two halves to one another to form an assembled box, the semicylinders of a first half having cut out portions addressing each other and the semicylinders of the other half of the box each having a tangential projection extending parallel relative to said cut out portions of the first half, and guide fins on said bridging flange members that form a guide channel when said box is in its assembled condition.

12. The ink ribbon box of claim 11, wherein one of said tangential projections has recesses and the corresponding opposite cutaway portions have stepped notches.

* * * * *